US006478586B1

(12) United States Patent
Ma

(10) Patent No.: US 6,478,586 B1
(45) Date of Patent: Nov. 12, 2002

(54) ELECTRICAL CONNECTOR HAVING CONDUCTIVE TERMINALS THAT ARE PROVIDED WITH A DIELECTRIC COATING

(75) Inventor: Danny Ma, Taipei Hsien (TW)

(73) Assignee: Advanced Connection Technology Inc., Taipei (TW)

( * ) Notice: Subject to any disclaimer, the term of this patent is extended or adjusted under 35 U.S.C. 154(b) by 0 days.

(21) Appl. No.: 09/971,569

(22) Filed: Oct. 9, 2001

(51) Int. Cl.[7] ..... H01R 12/00

(52) U.S. Cl. ..... 439/79; 439/924.1; 439/86; 439/886; 439/931

(58) Field of Search ..... 439/79, 924.1, 439/86, 886, 931

(56) References Cited

U.S. PATENT DOCUMENTS 4,665,614 A * 5/1987 Stipanuk et al. ..... 29/884
4,780,093 A * 10/1988 Walse et al. ..... 439/418
4,921,430 A * 5/1990 Matsuoka ..... 439/72

* cited by examiner

*Primary Examiner*—Gary R Paumen
*Assistant Examiner*—James R. Harvey
(74) *Attorney, Agent, or Firm*—Baker Botts L.L.P.

(57) ABSTRACT

An electrical connector includes a connector housing and a plurality of conductive terminals. Each of the conductive terminals is mounted on the housing, includes a conductive terminal body with first and second contact surfaces, and is provided with a dielectric coating at portions other than the first and second contact surfaces, thereby insulating each of the terminals from adjacent ones on the housing.

4 Claims, 2 Drawing Sheets

ELECTRICAL CONNECTOR HAVING CONDUCTIVE TERMINALS THAT ARE PROVIDED WITH A DIELECTRIC COATING

BACKGROUND OF THE INVENTION

1. Field of the Invention

The invention relates to an electrical connector, more particularly to an electrical connector having conductive terminals that are provided with a dielectric coating.

2. Description of the Related Art

Referring to FIG. 1, a conventional electrical connector 5 is shown to comprise a connector housing 51 and a plurality of conductive terminals 52. The connector housing 51 is made from an insulator material. The conductive terminals 52 are mounted on the connector housing 51. Each of the conductive terminals 52 is made from a conductive material, such as copper, and includes a first end part 521 disposed on one side of the connector housing 51, and a second end part 522 disposed opposite to the first end part 521. The first end part 521 is adapted to connect electrically with a circuit board 6, whereas the second end part 522 is adapted to connect electrically with a corresponding terminal of a complementary connector (not shown).

In the conventional electrical connector 5, the spaces among adjacent ones of the terminals 52 must be sufficiently large so as to prevent the occurrence of short circuits. As such, the housing 51 has to be enlarged, which is contrary to the current trend of miniaturization of electronic products.

SUMMARY OF THE INVENTION

Therefore, the main object of the present invention is to provide an electrical connector having conductive terminals that are provided with a dielectric coating so as to overcome the aforementioned drawback of the prior art.

Accordingly, an electrical connector of this invention comprises a connector housing and a plurality of conductive terminals. The connector housing is made from an insulator material. Each of the conductive terminals is mounted on the connector housing, and includes a conductive terminal body with a first contact surface and a second contact surface. The first contact surface is adapted for connecting electrically with a circuit board. The second contact surface is adapted for connecting electrically with a corresponding terminal of a complementary connector. Each of the conductive terminals is provided with a dielectric coating at portions other than the first and second contact surfaces, thereby exposing the first and second surfaces, and thereby insulating each of the conductive terminals from adjacent ones of the conductive terminals on the connector housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
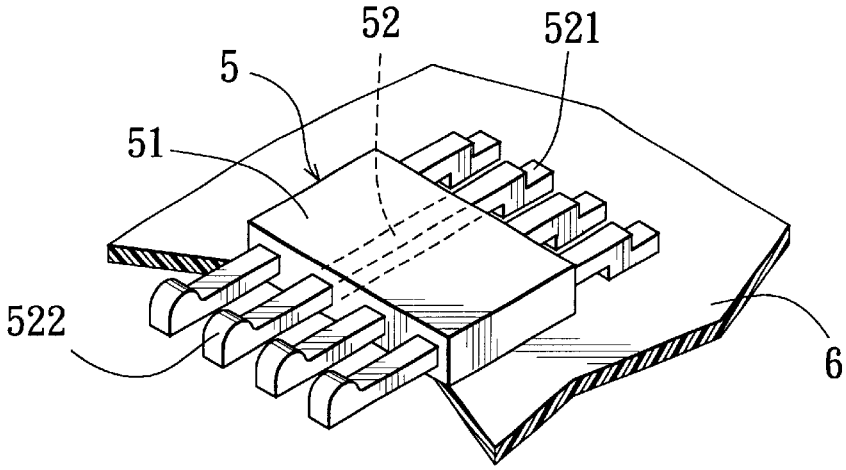
FIG.1 PRIOR ART
FIG. 1 is a perspective view of a conventional electrical connector.

Before the present invention is described in greater detail, it should be noted that like elements are denoted by the same reference numerals throughout the disclosure.

Figure 2:
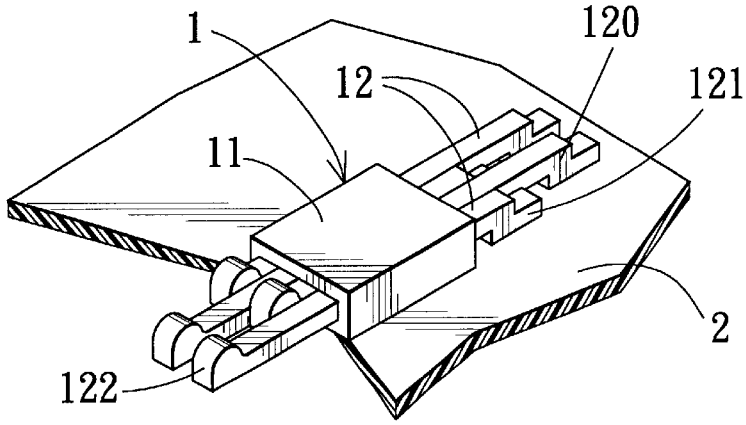
FIG. 2 is a perspective view of the first preferred embodiment of an electrical connector according to the present invention.
Figure 3:
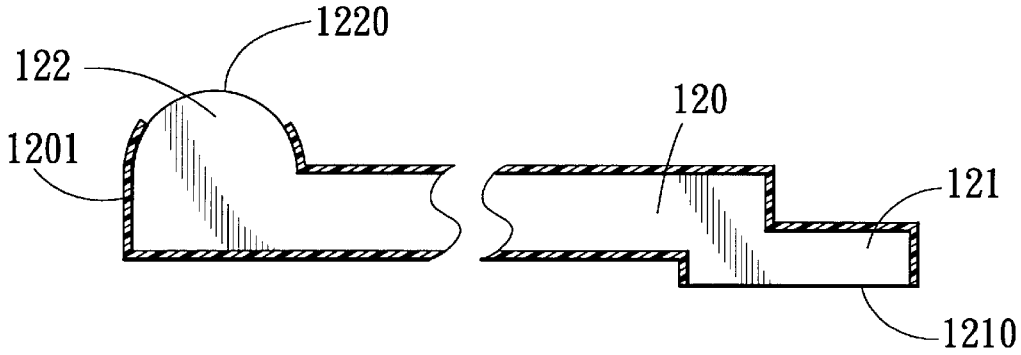
FIG. 3 is a fractional schematic partly sectional view of a conductive terminal of the preferred embodiment of FIG. 2.

Referring to FIGS. 2 and 3, the first preferred embodiment of an electrical connector 1 according to the present invention is shown to comprise a connector housing 11 and a plurality of conductive terminals 12. The connector housing 11 is made from an insulator material. Each of the conductive terminals 12 is mounted on the connector housing 11, and includes a conductive terminal body 120 with a first contact part 121 and a second contact part 122. The first contact part 121 has a first contact surface 1210 adapted for connecting electrically with a circuit board 2. The second contact part 122 has a second contact surface 1220 adapted for connecting electrically with a corresponding terminal of a complementary connector (not shown) for signal transmission purposes. Each of the conductive terminals 12 is provided with a dielectric coating 1201 (usually about 0.01 mm in thickness) at portions other than the first and second contact surfaces 1210, 1220, thereby exposing the first and second contact surfaces 1210, 1220 to permit electrical connection with the circuit board 2 or the complementary connector, and thereby insulating each of the conductive terminals 12 from adjacent ones of the conductive terminals 12 on the connector housing 11. As such, the conductive terminals 12 can be arranged densely on the housing 11 in order to minimize the size of the latter.

In actual use, to avoid electrical connection among adjacent first or second contact parts 121, 122 of the terminals 12, the first and second contact parts 121, 122 are respectively in a staggered arrangement relative to the connector housing 11, as best shown in FIG. 2.

Figure 4:
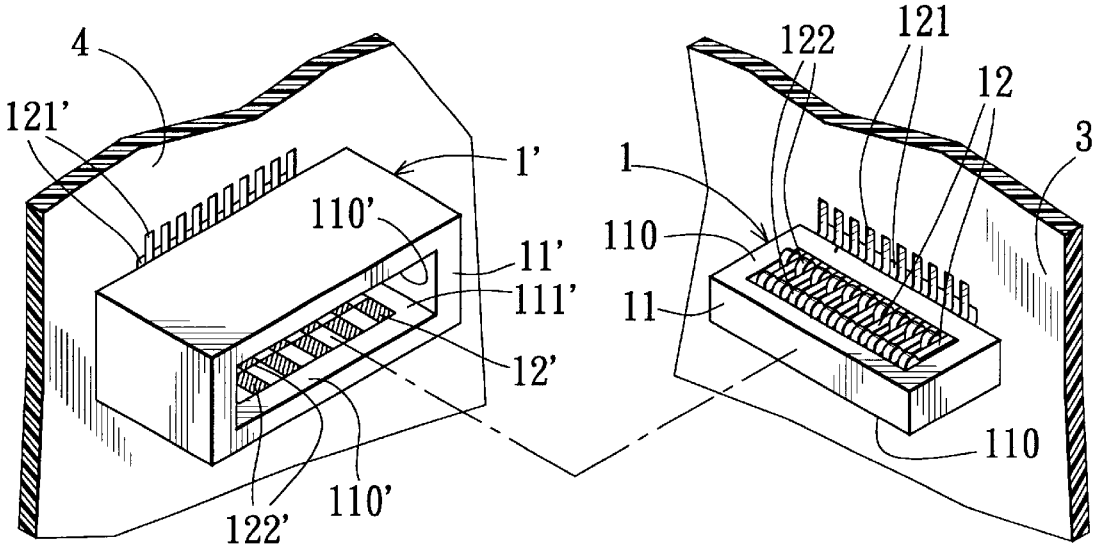
FIG. 4 is a perspective view showing complementary electrical connectors of the second preferred embodiment according to the present invention.

FIG. 4 illustrates complementary electrical connectors 1, 1' of the second preferred embodiment of this invention. The first electrical connector 1 includes a rectangular connector housing 11 with top and bottom surfaces 110. The second contact parts 122 of terminals 12 that are mounted in the housing 11 protrude from the top and bottom surfaces 110 of the housing 11. The first contact parts 121 of the terminals 12 are welded to a circuit board 3. The rectangular connector housing 11' of the second electrical connector 1' is formed with a groove portion 111' for receiving the housing 11 of the first electrical connector 1, and has upper and lower inner surfaces 110'. The second contact parts 122' (shown in shaded lines) of the conductive terminals 12' are disposed on the inner surfaces 110' of the housing 11' in order to establish electrical contact with the second contact parts 122 of the first electrical connector 1. The first contact parts 121' of the terminals 12' are welded to a circuit board 4. In this embodiment, plug and socket relationship is formed when the housing 11 of the first electrical connector is inserted into the housing 11' of the second electrical connector 1'. After interengaging the housings 11, 11', the second contact parts 122, 122' of the first and second electrical connectors 1, 1' are electrically connected so as to enable signal transmission therethrough.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An electrical connector comprising:

a connector housing made from an insulator material; and a plurality of conductive terminals mounted on said connector housing, each of said conductive terminals including a conductive terminal body with a first contact surface adapted for connecting electrically with a circuit board, and a second contact surface adapted for connecting electrically with a corresponding terminal of a complementary connector;

wherein each of said conductive terminals is provided with a dielectric coating at portions other than said first and second contact surfaces, thereby exposing said first and second surfaces, and thereby insulating each of said conductive terminals from adjacent ones of said conductive terminals on said connector housing wherein a first of said plurality of conductive terminals extends further from said connector housing than a second of said plurality of conductive terminals.

2. The electrical connector of claim 1, wherein said dielectric coating has a thickness greater than zero millimeters and less than or equal to about 0.01 millimeters.

3. The electrical connector of claim 1, wherein a first of said plurality of conductive terminals contacts a second of said plurality of conductive terminals.

4. An electrical connector comprising:

a connector housing;

a first conductive terminal mounted on said connector housing, wherein said first conductive terminal comprises a first contact surface adapted to connect said first conductive terminal to a circuit board and a dielectric coating formed on or adjacent to at least a portion of said first conductive terminal; and a second conductive terminal mounted on said connector housing and positioned adjacent to said first conductive terminal, wherein said second conductive terminal comprises a second contact surface adapted to connect said second conductive terminal to said circuit board and a dielectric portion formed on or adjacent to at least a coating of said second conductive terminal, wherein said first conductive terminal extends further from said connector housing than said second conductive terminal.

* * * * *